US008869727B1

(12) United States Patent
Vandenworm

(10) Patent No.: US 8,869,727 B1
(45) Date of Patent: Oct. 28, 2014

(54) BUOYANT STRUCTURE

(71) Applicant: SSP Technologies, Inc., Grand Cayman, KY (US)

(72) Inventor: Nicolaas Johannes Vandenworm, Houston, TX (US)

(73) Assignee: SSP Technologies, Inc., Grand Cayman (KY)

( * ) Notice: Subject to any disclaimer, the term of this patent is extended or adjusted under 35 U.S.C. 154(b) by 0 days.

(21) Appl. No.: 14/105,321

(22) Filed: Dec. 13, 2013

Related U.S. Application Data

(63) Continuation-in-part of application No. 13/369,600, filed on Feb. 9, 2012, now Pat. No. 8,662,000, which is a continuation-in-part of application No. 12/914,709, filed on Oct. 28, 2010, now Pat. No. 8,251,003.

(60) Provisional application No. 61/259,201, filed on Nov. 18, 2009, provisional application No. 61/262,533, filed on Nov. 18, 2009, provisional application No. 61/521,701, filed on Aug. 9, 2011.

(51) Int. Cl.

| | |
|---|---|
| ***B63B 35/40*** | (2006.01) |
| ***E02B 3/06*** | (2006.01) |
| ***B63B 35/50*** | (2006.01) |
| ***B63B 23/00*** | (2006.01) |
| ***B63B 21/50*** | (2006.01) |

(52) U.S. Cl.

CPC ..... *E02B 3/064* (2013.01); *B63B 35/50* (2013.01); *B63B 23/00* (2013.01); *B63B 21/50* (2013.01)

USPC ..... 114/259

(58) Field of Classification Search

USPC ..... 114/263, 264, 259, 248

IPC ..... B63B 23/30

See application file for complete search history.

(56) References Cited

U.S. PATENT DOCUMENTS

| | | | | |
|---|---|---|---|---|
| 2,156,635 | A | 5/1939 | Mascuch et al. | |
| 3,041,639 | A | 7/1962 | Atlas | |
| 4,282,822 | A | 8/1981 | Jackson | |
| 4,446,808 | A * | 5/1984 | Colin | 114/248 |
| 4,549,835 | A * | 10/1985 | Ando et al. | 405/4 |
| 4,640,214 | A | 2/1987 | Bruns | |
| 4,679,517 | A * | 7/1987 | Kramer | 114/45 |
| 4,984,935 | A | 1/1991 | de Oliveira Filho et al. | |
| 5,573,353 | A | 11/1996 | Recalde | |
| 7,958,835 | B2 | 6/2011 | Srinivasan | |
| 8,662,000 | B2 * | 3/2014 | Vandenworm | 114/263 |
| 2013/0133563 | A1 | 5/2013 | Kroecker | |

* cited by examiner

*Primary Examiner* — Stephen Avila

(74) *Attorney, Agent, or Firm* — Buskop Law Group, PC; Wendy Buskop

(57) ABSTRACT

A buoyant structure having a hull, a main deck, an upper frustoconical portion, a lower frustoconical side section, a lower ellipsoidal section and a matching ellipsoidal keel with a tunnel formed within the hull for containing water to an operational depth creating a passageway to locations exterior of the hull and dimensioned to receive a watercraft. The tunnel having a plurality of tunnel sides, a tunnel floor formed between the tunnel sides and a plurality of dynamic movable tendering mechanisms connected to each tunnel side. The dynamic movable tendering mechanisms connected proximate to the operational depth for contacting with at least one side of a watercraft, enabling the tunnel to receive a watercraft securely for loading and unloading while the buoyant structure is at an operational depth on a body of water.

20 Claims, 9 Drawing Sheets

BUOYANT STRUCTURE

CROSS REFERENCE TO RELATED APPLICATIONS

The present application is a Continuation in Part of U.S. patent application Ser. No. 13/369,600 filed on Feb. 9, 2012, now U.S. Pat. No. 8,662,000 issued Mar. 4, 2014 entitled "STABLE OFFSHORE FLOATING DEPOT," which is a Continuation in Part of U.S. patent application Ser. No. 12/914,709 filed on Oct. 28, 2010, now U.S. Pat. No. 8,251,003 issued Aug. 28, 2012 which claims the benefit of U.S. Provisional Patent Application Ser. No. 61/259,201 filed on Nov. 8, 2009 and U.S. Provisional Patent Application Ser. No. 61/262,533 filed on Nov. 18, 2009; and claims the benefit of U.S. Provisional Patent Application Ser. No. 61/521,701 filed on Aug. 9, 2011. These references are hereby incorporated in their entirety.

FIELD

The present embodiments generally relate to a buoyant structure for supporting offshore oil and gas operations.

BACKGROUND

A need exists for a buoyant structure that provides kinetic energy absorption capabilities from a watercraft by providing a plurality of dynamic movable tendering mechanisms in a tunnel formed in the buoyant structure.

A further need exists for a buoyant structure that provides wave damping and wave breakup within a tunnel formed in the buoyant structure.

A need exists for a buoyant structure that provides friction forces to a hull of a watercraft in the tunnel.

The present embodiments meet these needs.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a buoyant structure for supporting offshore oil and gas operations.

The embodiments enable safe entry of a watercraft into a buoyant structure in both harsh and benign offshore water environments, with 4 foot to 40 foot seas.

The embodiments prevent injuries to personnel from equipment falling off the buoyant structure by providing a tunnel to contain and protect watercraft for receiving personnel within the buoyant structure.

The embodiments provide a buoyant structure located in an offshore field that enables a quick exit from the offshore structure by many personnel simultaneously, in the case of an approaching hurricane or tsunami.

The embodiments provide a means to quickly transfer many personnel, such as from 200 to 500 people safely from an adjacent platform on fire to the buoyant structure in less than 1 hour.

The embodiments enable the offshore structure to be towed to an offshore disaster and operate as a command center to facilitate in the control of a disaster, and can act as a hospital, or triage center.

Figure 1:
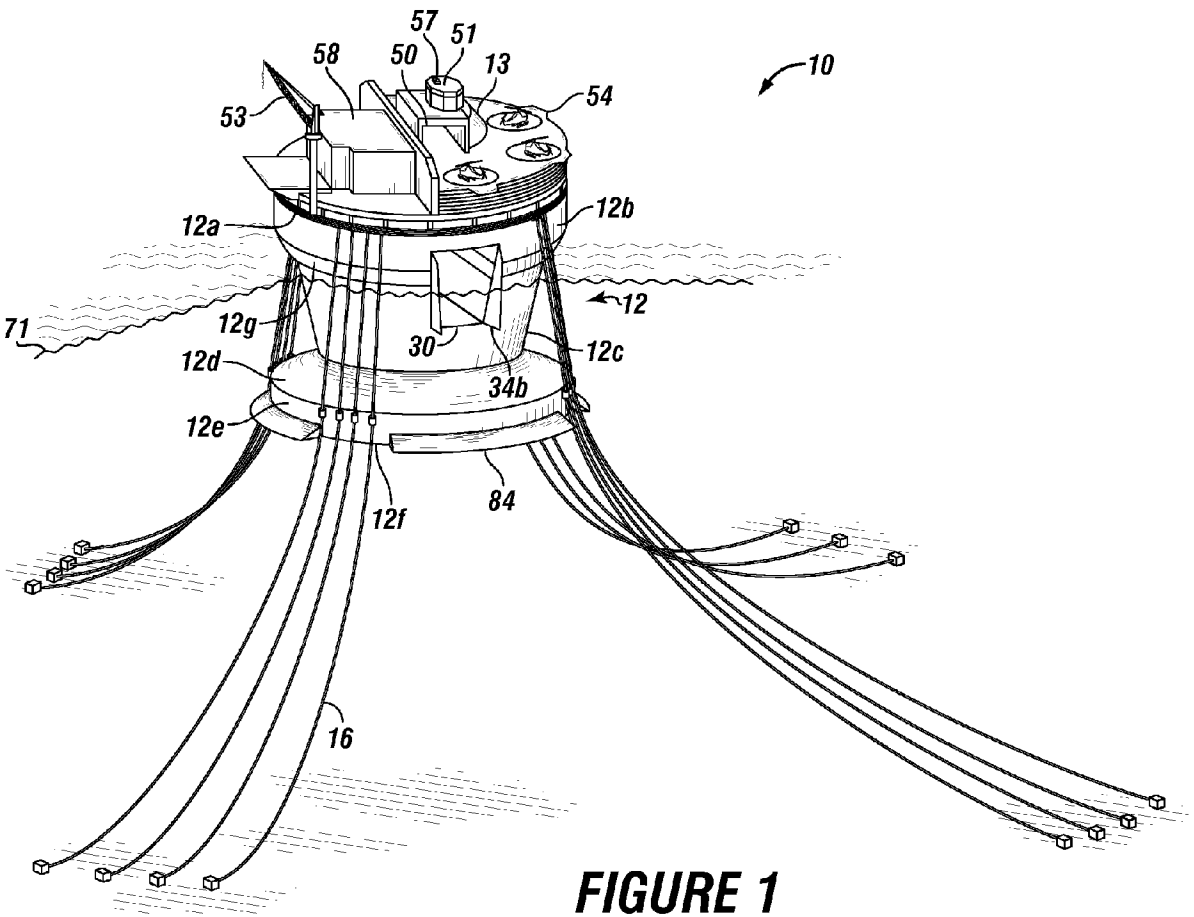
FIG. 1 is a perspective view of a buoyant structure.

Turning now to the Figures, FIG. 1 depicts a buoyant structure for operationally supporting offshore exploration, drilling, production, and storage installations according to an embodiment of the invention.

The buoyant structure 10 can include a hull 12, which can carry a superstructure 13 thereon. The superstructure 13 can include a diverse collection of equipment and structures, such as living quarters and crew accommodations 58, equipment storage, a heliport 54, and a myriad of other structures, systems, and equipment, depending on the type of offshore operations to be supported. Cranes 53 can be mounted to the superstructure. The hull 12 can be moored to the seafloor by a number of catenary mooring lines 16. The superstructure can include an aircraft hangar 50. A control tower 51 can be built on the superstructure. The control tower can have a dynamic position system 57.

The buoyant structure 10 can have a tunnel 30 with a tunnel opening in the hull 12 to locations exterior of the tunnel.

The tunnel 30 can receive water while the buoyant structure 10 is at an operational depth 71.

The buoyant structure can have a unique hull shape.

Figure 2:
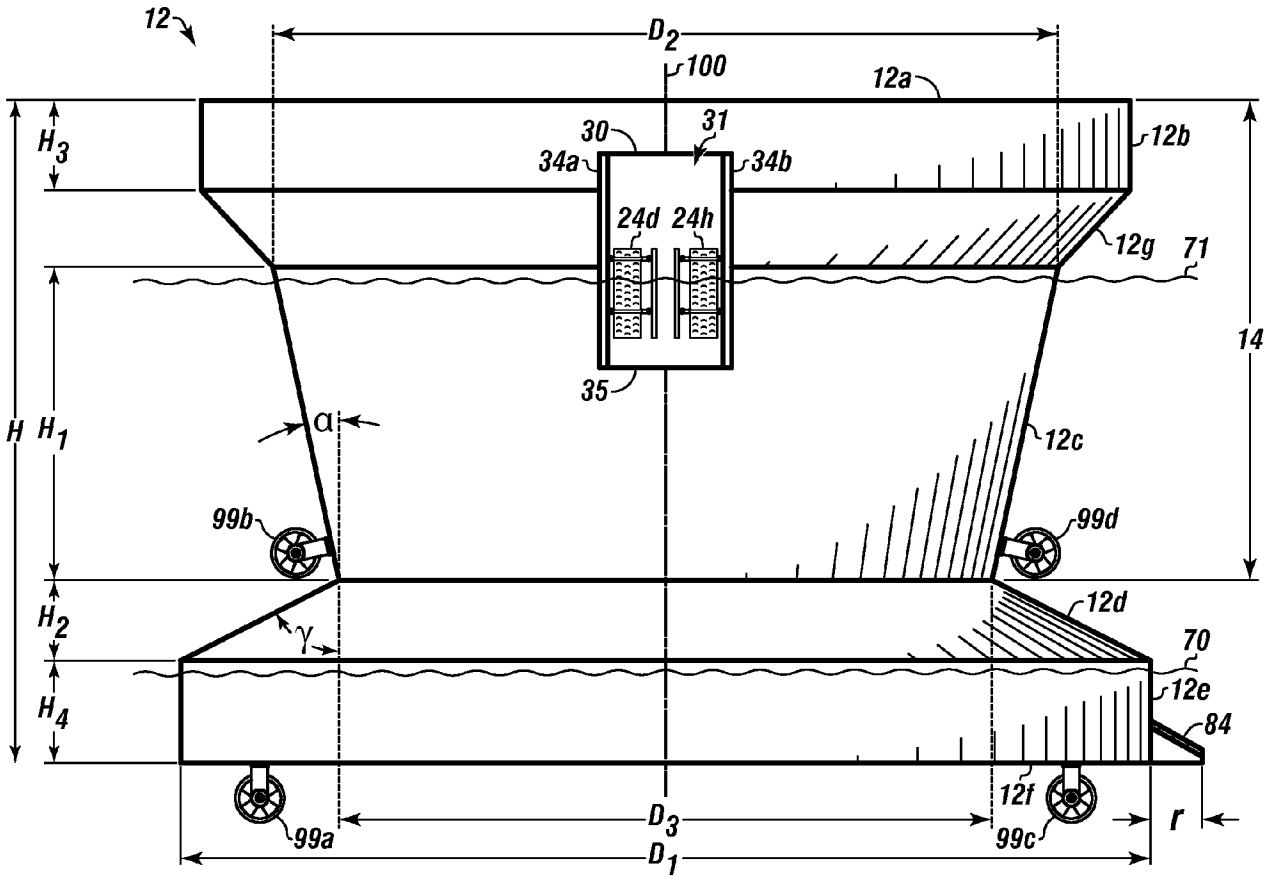
FIG. 2 is a vertical profile drawing of the hull of the buoyant structure.

Referring to FIGS. 1 and 2, the hull 12 of the buoyant structure 10 can have a main deck 12*a*, which can be circular; and a height H. Extending downwardly from the main deck 12*a* can be an upper frustoconical portion 14.

In embodiments, the upper frustoconical portion 14 can have an upper cylindrical side section 12*b* extending downwardly from the main deck 12*a*, an inwardly-tapering upper frustoconical side section 12*g* located below the upper cylindrical side section 12*b* and connecting to a lower inwardly-tapering frustoconical side section 12*c*.

The buoyant structure 10 also can have a lower frustoconical side section 12*d* extending downwardly from the lower inwardly-tapering frustoconical side section 12*c* and flares outwardly. Both the lower inwardly-tapering frustoconical side section 12*c* and the lower frustoconical side section 12*d* can be below the operational depth 71.

A lower ellipsoidal section 12*e* can extend downwardly from the lower frustoconical side section 12*d*, and a matching ellipsoidal keel 12*f*.

The lower inwardly-tapering frustoconical side section 12*c* can have a substantially greater vertical height H1 than lower frustoconical side section 12*d* shown as H2. Upper cylindrical side section 12*b* can have a slightly greater vertical height H3 than lower ellipsoidal section 12*e* shown as H4.

As shown, the upper cylindrical side section 12*b* can connect to inwardly-tapering upper frustoconical side section 12*g* so as to provide for a main deck of greater radius than the hull radius along with the superstructure 13, which can be round, square or another shape, such as a half moon. Inwardly-tapering upper frustoconical side section 12*g* can be located above the operational depth 71.

The tunnel 30 can have at least one closable door 34*a* and 34*b* that alternatively or in combination, can provide for weather and water protection to the tunnel 30.

Fin-shaped appendages 84 can be attached to a lower and an outer portion of the exterior of the hull.

The hull 12 is depicted with a plurality of catenary mooring lines 16 for mooring the buoyant structure to create a mooring spread.

FIG. 2 is a simplified view of a vertical profile of the hull according to an embodiment.

The tunnel 30 can have a plurality of dynamic movable tendering mechanisms 24*d* and 24*h* disposed within and connected to the tunnel sides.

In an embodiment, the tunnel 30 can have closable doors 34*a* and 34*b* for opening and closing the tunnel opening 31.

The tunnel floor 35 can accept water when the buoyant structure is at an operational depth 71.

Two different depths are shown, the operational depth 71 and the transit depth 70.

The dynamic movable tendering mechanisms 24*d* and 24*h* can be oriented above the tunnel floor 35 and can have portions that are positioned both above the operational depth 71 and extend below the operational depth 71 inside the tunnel 30.

The main deck 12*a*, upper cylindrical side section 12*b*, inwardly-tapering upper frustoconical side section 12*g*, lower inwardly-tapering frustoconical side section 12*c*, lower frustoconical side section 12*d*, lower ellipsoidal section 12*e*, and matching ellipsoidal keel 12*f* are all co-axial with a common vertical axis 100. In embodiments, the hull 12 can be characterized by an ellipsoidal cross section when taken perpendicular to the vertical axis 100 at any elevation.

Due to its ellipsoidal planform, the dynamic response of the hull 12 is independent of wave direction (when neglecting any asymmetries in the mooring system, risers, and underwater appendages), thereby minimizing wave-induced yaw forces. Additionally, the conical form of the hull 12 is structurally efficient, offering a high payload and storage volume per ton of steel when compared to traditional ship-shaped offshore structures. The hull 12 can have ellipsoidal walls which are ellipsoidal in radial cross-section, but such shape may be approximated using a large number of flat metal plates rather than bending plates into a desired curvature. Although an ellipsoidal hull planform is preferred, a polygonal hull planform can be used according to alternative embodiments.

In embodiments, the hull 12 can be circular, oval or elliptical forming the ellipsoidal planform.

An elliptical shape can be advantageous when the buoyant structure is moored closely adjacent to another offshore platform so as to allow gangway passage between the two structures. An elliptical hull can minimize or eliminate wave interference.

The specific design of the lower inwardly-tapering frustoconical side section 12*c* and the lower frustoconical side section 12*d* generates a significant amount of radiation damping resulting in almost no heave amplification for any wave period, as described below.

Lower inwardly-tapering frustoconical side section 12*c* can be located in the wave zone. At operational depth 71, the waterline can be located on lower inwardly-tapering frustoconical side section 12*c* just below the intersection with upper cylindrical side section 12*b*. Lower inwardly-tapering frustoconical side section 12*c* can slope at an angle ($\alpha$) with respect to the vertical axis 100 from 10 degrees to 15 degrees. The inward flare before reaching the waterline significantly dampens downward heave, because a downward motion of the hull 12 increases the waterplane area. In other words, the hull area normal to the vertical axis 100 that breaks the water's surface will increase with downward hull motion, and such increased area is subject to the opposing resistance of the air and or water interface. It has been found that 10 degrees to 15 degrees of flare provides a desirable amount of damping of downward heave without sacrificing too much storage volume for the vessel.

Similarly, lower frustoconical side section 12*d* dampens upward heave. The lower frustoconical side section 12*d* can be located below the wave zone (about 30 meters below the waterline). Because the entire lower frustoconical side section 12*d* can be below the water surface, a greater area (normal to the vertical axis 100) is desired to achieve upward damping. Accordingly, the first diameter $D_1$ of the lower hull section can be greater than the second diameter $D_2$ of the lower inwardly-tapering frustoconical side section 12*c*. The lower frustoconical side section 12*d* can slope at an angle ($\gamma$) with respect to the vertical axis 100 from 55 degrees to 65 degrees. The lower section can flare outwardly at an angle greater than or equal to 55 degrees to provide greater inertia for heave roll and pitch motions. The increased mass contributes to natural periods for heave pitch and roll above the expected wave energy. The upper bound of 65 degrees is based on avoiding abrupt changes in stability during initial ballasting on installation. That is, lower frustoconical side section 12*d* can be perpendicular to the vertical axis 100 and achieve a desired amount of upward heave damping, but such a hull profile would result in an undesirable step-change in stability during initial ballasting on installation. The connection point between upper frustoconical portion 14 and the lower frustoconical side section 12*d* can have a third diameter $D_3$ smaller than the first and second diameters $D_1$ and $D_2$.

The transit depth 70 represents the waterline of the hull 12 while it is being transited to an operational offshore position. The transit depth is known in the art to reduce the amount of energy required to transit a buoyant vessel across distances on the water by decreasing the profile of buoyant structure which contacts the water. The transit depth is roughly the intersection of lower frustoconical side section 12*d* and lower ellipsoidal section 12*e*. However, weather and wind conditions can provide need for a different transit depth to meet safety guidelines or to achieve a rapid deployment from one position on the water to another.

In embodiments, the center of gravity of the offshore vessel can be located below its center of buoyancy to provide inherent stability. The addition of ballast to the hull 12 is used to lower the center of gravity. Optionally, enough ballast can be added to lower the center of gravity below the center of buoyancy for whatever configuration of superstructure and payload is to be carried by the hull 12.

The hull is characterized by a relatively high metacenter. But, because the center of gravity (CG) is low, the metacentric height is further enhanced, resulting in large righting moments. Additionally, the peripheral location of the fixed ballast further increases the righting moments.

The buoyant structure aggressively resists roll and pitch and is said to be "stiff." Stiff vessels are typically characterized by abrupt jerky accelerations as the large righting moments counter pitch and roll. However, the inertia associated with the high total mass of the buoyant structure, enhanced specifically by the fixed ballast, mitigates such accelerations. In particular, the mass of the fixed ballast increases the natural period of the buoyant structure to above the period of the most common waves, thereby limiting wave-induced acceleration in all degrees of freedom.

In an embodiment, the buoyant structure can have thrusters 99*a*-99*d*.

Figure 3:
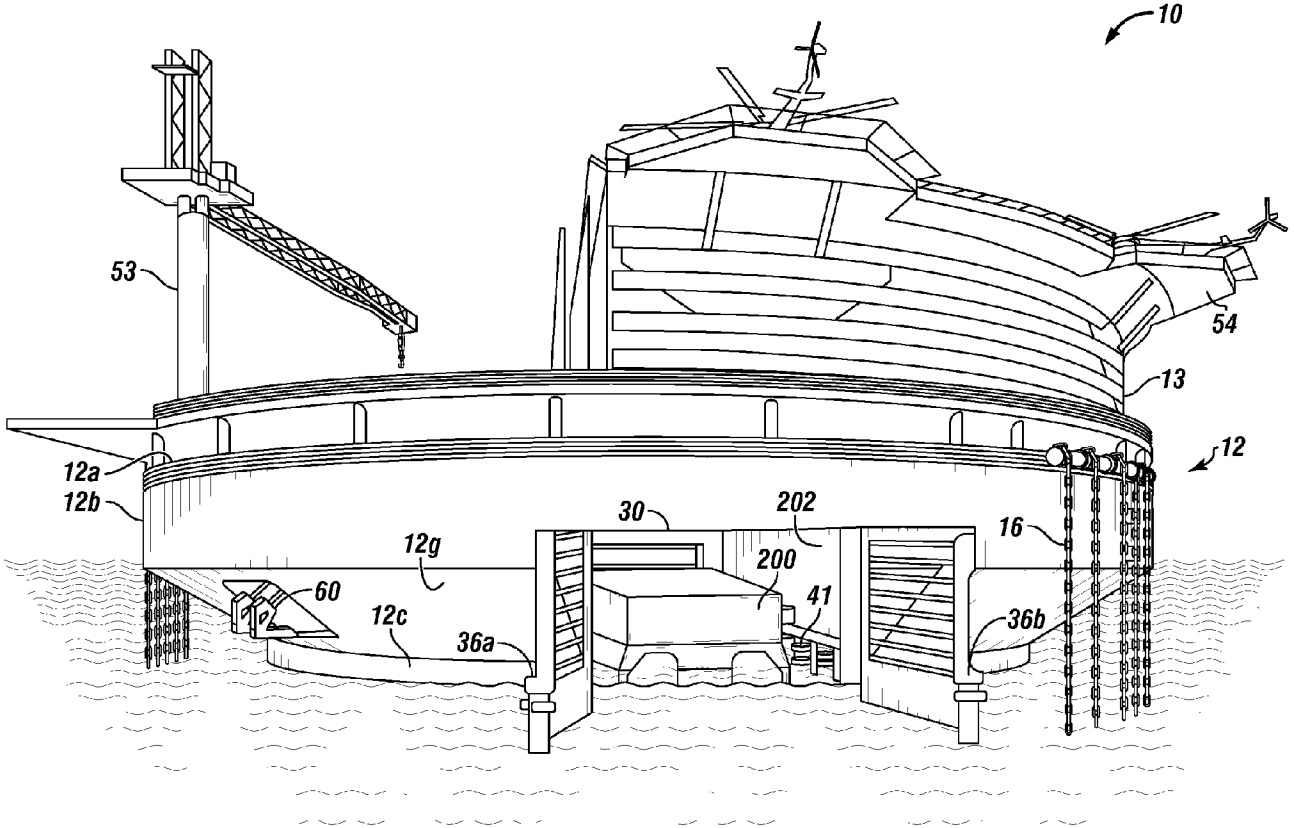
FIG. 3 is an enlarged perspective view of the floating buoyant structure at operational depth.

FIG. 3 shows the buoyant structure 10 with the main deck 12*a* and the superstructure 13 over the main deck.

In embodiments, the crane 53 can be mounted to the superstructure 13, which can include a heliport 54.

In this view a watercraft 200 is in the tunnel having come into the tunnel through the tunnel opening 30 and is positioned between the tunnel sides, of which tunnel side 202 is labeled. A boat lift 41 is also shown in the tunnel, which can raise the watercraft above the operational depth in the tunnel.

The tunnel opening 30 is shown with two doors, each door having a door fender 36*a* and 36*b* for mitigating damage to a watercraft attempting to enter the tunnel, but not hitting the doors.

The door fenders can allow the watercraft to impact the door fenders safely if the pilot cannot enter the tunnel directly due to at least one of large wave and high current movement from a location exterior of the hull.

The catenary mooring lines 16 are shown coming from the upper cylindrical side section 12*b*.

A berthing facility 60 is shown in the hull 12 in the portion of the inwardly-tapering upper frustoconical side section 12*g*. The inwardly-tapering upper frustoconical side section 12*g* is shown connected to the lower inwardly-tapering frustoconical side section 12*c* and the upper cylindrical side section 12*b*.

Figure 4A:
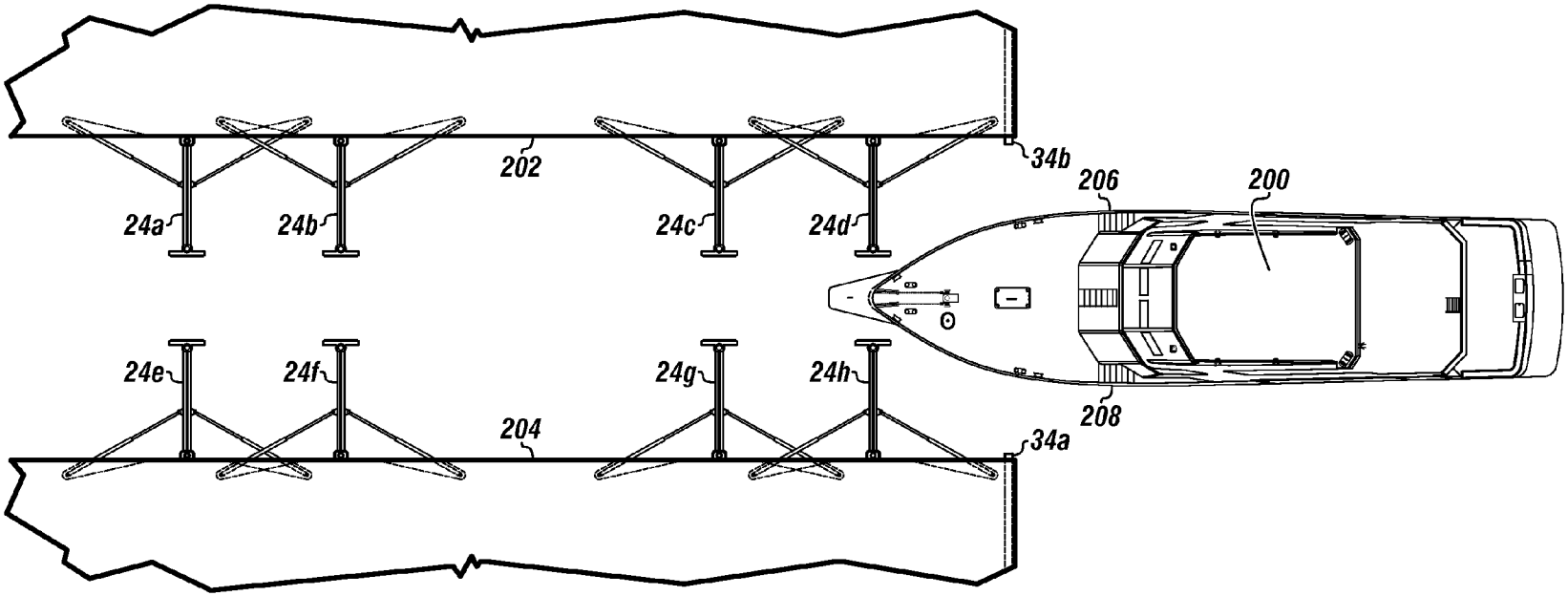
FIG. 4A is a top view of a plurality of dynamic moveable tendering mechanisms in a tunnel before a watercraft has contacted the dynamic moveable tendering mechanisms.

FIG. 4A shows the watercraft 200 entering the tunnel between tunnel sides 202 and 204 and connecting to the plurality of dynamic movable tendering mechanisms 24*a*-24*h*. Proximate to the tunnel opening are closable doors 34*a* and 34*b* which can be sliding pocket doors to provide either a weather tight or water tight protection of the tunnel from the exterior environment. The starboard side 206 hull and port side 208 hull of the watercraft are also shown.

Figure 4B:
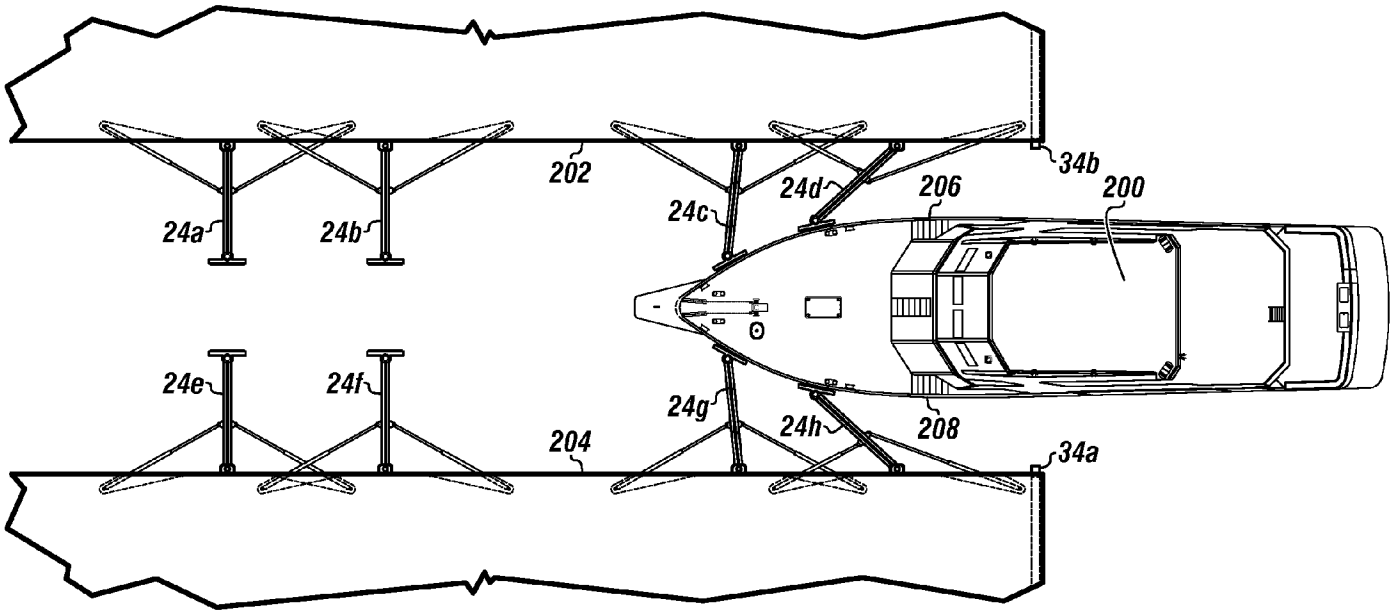
FIG. 4B is a top view of a plurality of dynamic moveable tendering mechanisms in a tunnel as the hull of a watercraft has contacted the dynamic moveable tendering mechanisms.

FIG. 4B shows the watercraft 200 inside a portion of the tunnel between tunnel sides 202 and 204 and connecting to the plurality of dynamic movable tendering mechanisms 24*a*-24*h*. Dynamic moveable tendering mechanisms 24*g* and 24*h* are shown contacting the port side 208 hull of the watercraft 200. Dynamic moveable tendering mechanisms 24*c* and 24*d* are seen contacting the starboard side 206 hull of the watercraft 200. The closable doors 34*a* and 34*b* are also shown.

Figure 4C:
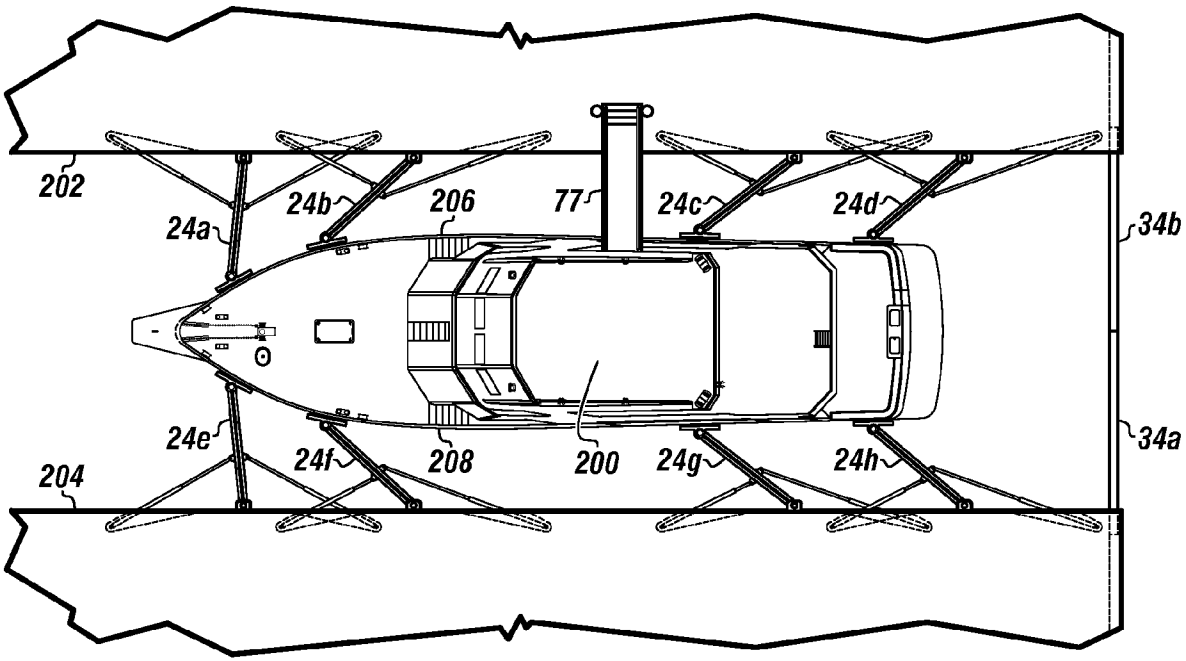
FIG. 4C is a top view of a plurality of dynamic moveable tendering mechanisms in a tunnel connecting to the watercraft with the doors closed.

FIG. 4C shows the watercraft 200 in the tunnel between tunnel sides 202 and 204 and connecting to the plurality of dynamic movable tendering mechanisms 24*a*-24*h* and also connected to a gangway 77. Proximate to the tunnel opening are closable doors 34*a* and 34*b* which can be sliding pocket doors oriented in a closed position providing either a weather tight or water tight protection of the tunnel from the exterior environment. The plurality of the dynamic moveable tendering mechanisms 24*a*-24*h* are shown in contact with the hull of the watercraft on both the starboard side 206 and port side 208.

Figure 5:
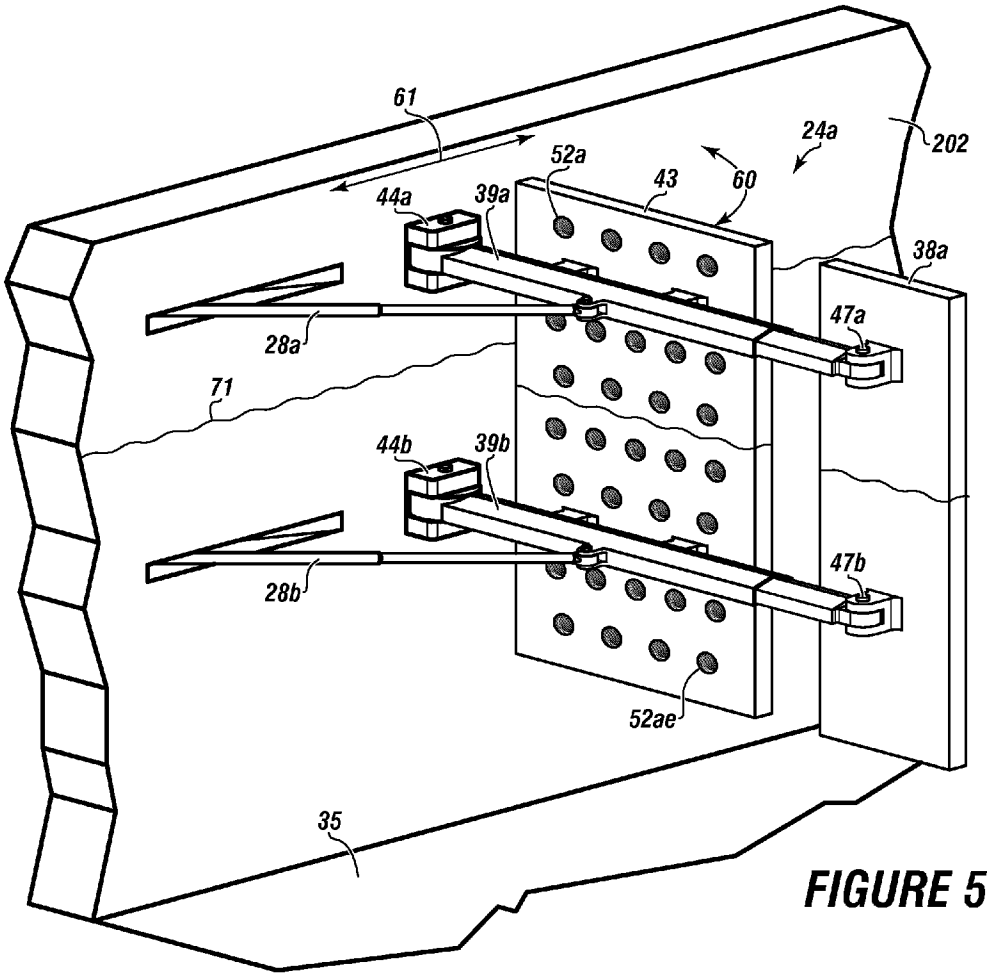
FIG. 5 is an elevated perspective view of one of the dynamic moveable tendering mechanisms.

FIG. 5 shows one of the plurality of the dynamic movable tendering mechanisms 24*a*. Each dynamic movable tendering mechanism can have a pair of parallel arms 39*a* and 39*b* mounted to a tunnel side, shown as tunnel side 202 in this Figure.

A fender 38*a* can connect to the pair of parallel arm 39*a* and 39*b* on the sides of the parallel arms opposite the tunnel side.

A plate 43 can be mounted to the pair of parallel arms 39*a* and 39*b* and between the fender 38*a* and the tunnel side 202.

The plate 43 can be mounted above the tunnel floor 35 and positioned to extend above the operational depth 71 in the tunnel and below the operational depth 71 in the tunnel simultaneously.

The plate 43 can be configured to dampen movement of the watercraft as the watercraft moves from side to side in the tunnel. The plate and entire dynamic movable tendering mechanism can prevent damage to the ship hull, and push a watercraft away from a ship hull without breaking towards the tunnel center. The embodiments can allow a vessel to bounce in the tunnel without damage.

A plurality of pivot anchors 44*a* and 44*b* can connect one of the parallel arms to the tunnel side.

Each pivot anchor can enable the plate to swing from a collapsed orientation against the tunnel sides to an extended orientation at an angle 60, which can be up to 90 degrees from a plane 61 of the wall enabling the plate on the parallel arm and the fender to simultaneously (i) shield the tunnel from waves and water sloshing effects, (ii) absorb kinetic energy of the watercraft as the watercraft moves in the tunnel, and (iii) apply a force to push against the watercraft keeping the watercraft away from the side of the tunnel.

A plurality of fender pivots 47*a* and 47*b* are shown, wherein each pivot can form a connection between each parallel arm and the fender 38*a*, each fender pivot can allow the fender to pivot from one side of the parallel arm to an opposite side of the parallel arm through at least 90 degrees as the watercraft contacts the fender 38*a*.

A plurality of openings 52*a*-52*ae* in the plate 43 can reduce wave action. Each opening can have a diameter from 0.1 meters to 2 meters. In embodiments, the openings 52 can be elipses.

At least one hydraulic cylinder 28*a* and 28*b* can be connected to each parallel arm for providing resistance to watercraft pressure on the fender and for extending and retracting the plate from the tunnel sides.

Figure 6:
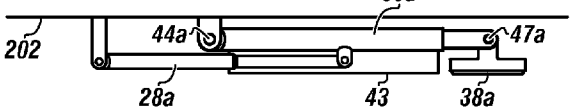
FIG. 6 is a collapsed top view of one of the dynamic moveable tendering mechanisms.

FIG. 6 shows one of the pair of parallel arms 39*a* mounted to a tunnel side 202 in a collapsed position.

The parallel arm 39*a* can be connected to the pivot anchor 44*a* that engages the tunnel side 202.

Fender pivot 47*a* can be mounted on the parallel arm opposite the anchor pivot.

The fender 38*a* can be mounted to the fender pivot 47*a*.

The plate 43 can be attached to the parallel arm 39*a*.

The hydraulic cylinder 28*a* can be attached to the parallel arm and the tunnel wall.

Figure 7:
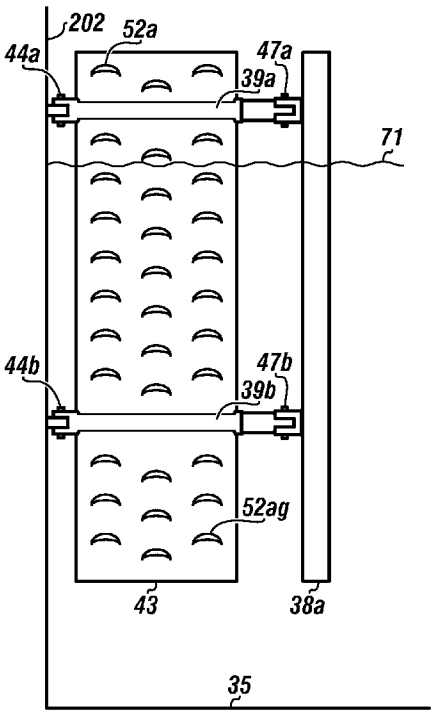
FIG. 7 is a side view of an embodiment of the dynamic moveable tendering mechanism.

FIG. 7 shows the plate 43 with openings 52*a*-52*ag* that are ellipsoidal in shape, wherein the plate is mounted above the tunnel floor 35.

The plate can extend both above and below the operational depth 71.

The tunnel side 202, pivot anchors 44*a* and 44*b*, parallel arms 39*a* and 39*b*, fender pivots 47*a* and 47*b*, and fender 38*a* are also shown.

Figure 8:
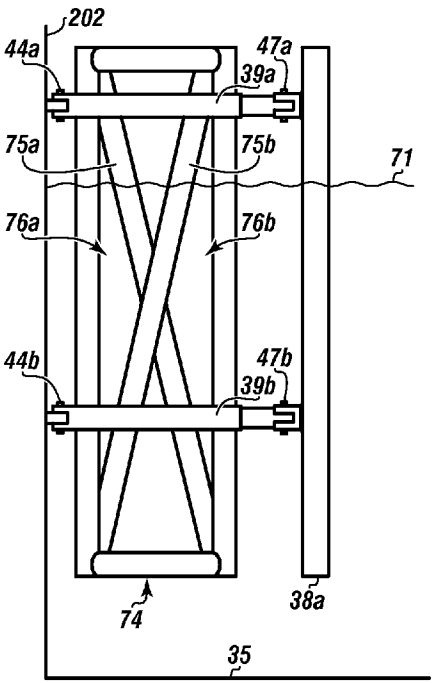
FIG. 8 is a side view of another embodiment of the dynamic moveable tendering mechanism.

FIG. 8 shows an embodiment of a dynamic moveable tendering mechanism formed from a frame 74 instead of the plate. The frame 74 can have intersecting tubulars 75*a* and 75*b* that form openings 76*a* and 76*b* for allowing water to pass while water in the tunnel is at an operational depth 71.

The tunnel side 202, tunnel floor 35, pivot anchors 44*a* and 44*b*, parallel arms 39*a* and 39*b*, fender pivots 47*a* and 47*b*, and fender 38*a* are also shown.

Figure 9:
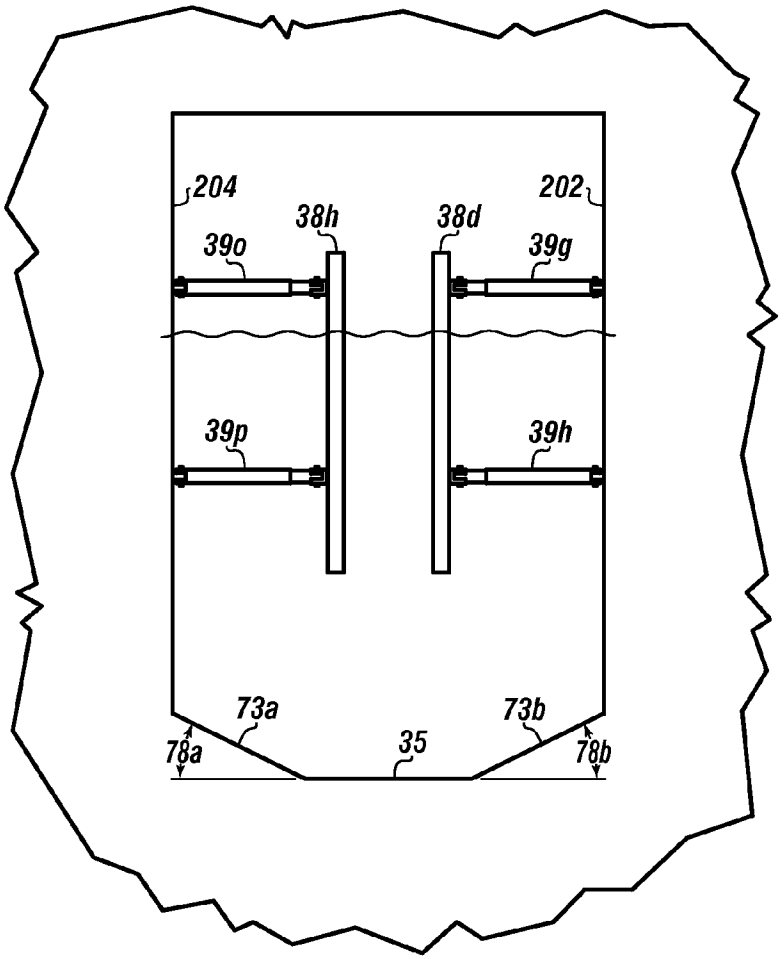
FIG. 9 is a cut away view of the tunnel.

FIG. 9 shows the tunnel floor 35 having lower tapering surfaces 73*a* and 73*b* at an entrance of the tunnel, providing a "beach effect" that absorbs surface wave energy effect inside of the tunnel. The lower tapering surfaces can be at an angle 78*a* and 78*b* that is from 3 degrees to 40 degrees.

Two fenders 38*h* and 38*d* can be mounted between two pairs of parallel arms. Fender 38*h* can be mounted between parallel arms 39*o* and 39*p*, and fender 38*d* can be mounted between parallel arms 39*g* and 39*h*.

In embodiments, the pair of parallel arms can be simultaneously extendable and retractable.

The tunnel walls 202 and 204 are also shown.

Figure 10:
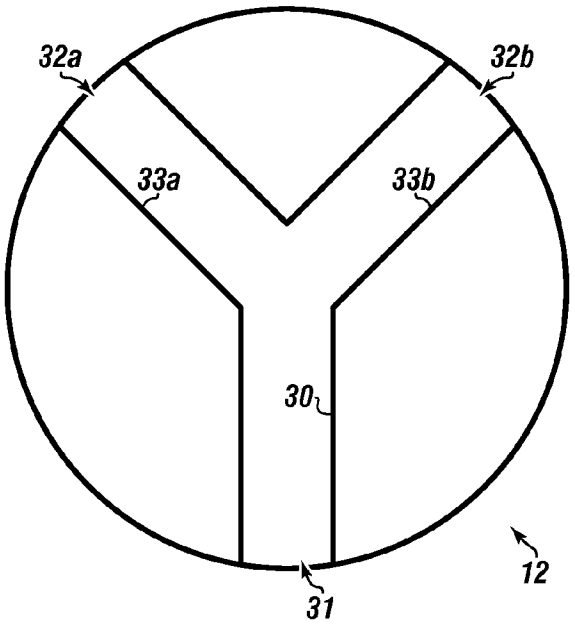
FIG. 10 is a top view of a Y-shaped tunnel in the hull of the buoyant structure.

FIG. 10 shows a Y-shaped configuration from a top cutaway view of the hull 12 with the tunnel 30 with the tunnel opening 31, in communication with a branch 33*a* and branch 33*b* going to additional openings 32*a* and 32*b* respectively.

The buoyant structure can have a transit depth and an operational depth, wherein the operational depth is achieved using ballast pumps and filling ballast tanks in the hull with water after moving the structure at transit depth to an operational location.

The transit depth can be from about 7 meters to about 15 meters, and the operational depth can be from about 45 meters to about 65 meters. The tunnel can be out of water during transit.

Straight, curved, or tapering sections in the hull can form the tunnel.

In embodiments, the plates, closable doors, and hull can be made from steel.

While these embodiments have been described with emphasis on the embodiments, it should be understood that within the scope of the appended claims, the embodiments might be practiced other than as specifically described herein.

What is claimed is:

1. A buoyant structure comprising:

a. a hull having a main deck, an upper frustoconical portion, a lower frustoconical side section, a lower ellipsoidal section and an ellipsoidal keel;

b. a tunnel formed within the hull, the tunnel containing water to an operational depth when the buoyant structure floats at the operational depth in a body of water, the tunnel being free of water when the buoyant structure floats at a transit depth in the body of water, the tunnel comprising:

(i) a tunnel opening in the upper frustoconical portion, the tunnel opening creating a passageway to locations exterior of the hull, the tunnel opening dimensioned to receive a watercraft;

(ii) a plurality of tunnel sides; and (iii) a tunnel floor formed between the tunnel sides creating an operational depth in the tunnel;

c. a main deck secured to the hull and covering the tunnel; and d. a plurality of dynamic movable tendering mechanisms connected to the tunnel sides, the dynamic movable tendering mechanisms connected proximate to the operational depth for contacting with at least one side of the watercraft, enabling the tunnel to receive the watercraft securely for loading and unloading while the buoyant structure is at the operational depth.

2. The buoyant structure of claim 1, comprising at least one closable door disposed at the tunnel opening to provide for selective isolation of the tunnel from locations exterior of the hull as the buoyant structure floats at the operational depth.

3. The buoyant structure of claim 2, wherein the at least one closable door is configured to provide weather protection and water protection and further comprises door fenders allowing the watercraft to impact the door fenders safely if the watercraft cannot enter the tunnel directly due to large waves, high current movement, or both from locations exterior of the hull.

4. The buoyant structure of claim 1, wherein at least one of the plurality of dynamic movable tendering mechanism comprises:

a. a pair of parallel arms mounted to at least one of the plurality of tunnel sides;

b. a fender connected to the pair of parallel arms on sides of the parallel arms opposite the tunnel side;

c. a plate mounted to the pair of parallel arms and mounted between the fender and the tunnel side, the plate additionally mounted above the tunnel floor and positioned to extend below the operational depth in the tunnel, wherein the plate is configured to dampen movement of the watercraft as the watercraft moves from side to side in the tunnel; and d. a plurality of pivot anchors, each pivot anchor connecting one of the parallel arms to the tunnel side, wherein the pivot anchor enables the plate to swing from a collapsed orientation against the tunnel side to an extended orientation at an angle that is up to 90 degrees from a plane of the wall enabling the plate on the parallel arms and the fender to simultaneously (i) shield the tunnel from water sloshing effects, (ii) absorb kinetic energy of the watercraft as the watercraft moves in the tunnel, and (ii) apply a force to push against the watercraft keeping the watercraft away from the tunnel sides.

5. The buoyant structure of claim 4, wherein the plate is positioned to extend above the operational depth in the tunnel and extend below the operational depth in the tunnel simultaneously, wherein the plate is configured to dampen movement of the watercraft as the watercraft moves from side to side in the tunnel.

6. The buoyant structure of claim 4, comprising at least one hydraulic cylinder connected to each parallel arm for providing resistance to the watercraft contacting the fender and for extending and retracting the plate from the tunnel sides.

7. The buoyant structure of claim 4, comprising a plurality of fender pivots, each fender pivot forming a connection between each parallel arm and the fender, each fender pivot allowing the fender to pivot from one side of the parallel arms to an opposite side of the parallel arms through at least 90 degrees as the watercraft contacts the fender.

8. The buoyant structure of claim 4, comprising a plurality of openings in the plate to reduce wave action.

9. The buoyant structure of claim 1, further comprising a boat lift in the tunnel.

10. The buoyant structure of claim 4, wherein the plate is a frame with intersecting tubulars, the intersecting tubulars providing support to the frame and forming water penetrating openings allowing water to pass.

11. The buoyant structure of claim 1, wherein the tunnel comprises at least one additional tunnel opening in the hull, opening to a location exterior of the hull.

12. The buoyant structure of claim 11, wherein the tunnel includes a plurality of branches, wherein each branch connects to an additional opening in the hull communicating to the location exterior of the hull.

13. The buoyant structure of claim 12, wherein the tunnel is formed in a "Y" shape with a plurality of tunnel openings.

14. The buoyant structure of claim 1, wherein the main deck has a superstructure comprising at least one member selected from the group consisting of: crew accommodations, a heliport, a crane, a control tower, a dynamic position system in the control tower, and an aircraft hangar.

15. The buoyant structure of claim 1, wherein the hull has a berthing facility and catenary mooring lines for mooring the buoyant structure to a seafloor.

16. The buoyant structure of claim 1, further comprising a gangway for traversing between the buoyant structure and the watercraft.

17. The buoyant structure of claim 1, comprising the hull with a center of gravity below a center of buoyancy to provide an inherent stability to the buoyant structure.

18. The buoyant structure of claim 1, comprising fin-shaped appendages attached to a lower and an outer portion of the exterior of the hull.

19. The buoyant structure of claim 1, further comprising lower tapering surfaces extending adjacent the tunnel floor, providing a "beach effect" that absorbs most of a surface wave energy, the lower tapering surfaces are formed at an angle that is from 3 degrees to 40 degrees from a vertical axis of the buoyant structure.

20. The buoyant structure of claim 1, wherein the upper frustoconical portion comprises:

a. an upper cylindrical side section extending downwardly from the main deck;

b. an inwardly-tapering upper frustoconical side section located below the upper cylindrical side section and maintained above the operational water level; and c. a lower inwardly-tapering frustoconical side section; and wherein a lower ellipsoidal section has a first diameter, the lower inwardly-tapering frustoconical side section has a second diameter less than first diameter, and the connection point between upper frustoconical portion and lower frustoconical side section has a third diameter smaller than the first and second diameters.

* * * * *